US005103713A

United States Patent [19]

Loving

[11] Patent Number: 5,103,713

[45] Date of Patent: Apr. 14, 1992

[54] IMAGING TARGET SIGHT

[75] Inventor: Ronald E. Loving, Simi Valley, Calif.

[73] Assignee: Hughes Aircraft Company, Los Angeles, Calif.

[21] Appl. No.: 612,240

[22] Filed: Nov. 13, 1990

[51] Int. Cl.[5] ..... F41F 3/042; F41G 1/38; F41G 1/46

[52] U.S. Cl. ..... 89/1.816; 89/41.19

[58] Field of Search ..... 244/3.12; 89/41.05, 89/41.06, 41.19, 1.816

[56] References Cited

U.S. PATENT DOCUMENTS

| | | | |
|---|---|---|---|
| 3,641,261 | 2/1972 | Chaplin et al. | 350/96.25 |
| 3,678,590 | 7/1972 | Hayward | 33/241 |
| 3,753,538 | 8/1973 | Morsh et al. | 244/3.12 |
| 4,255,013 | 3/1981 | Allen | 33/247 |
| 4,518,221 | 5/1985 | Francois | 350/96.26 |
| 4,611,771 | 9/1986 | Gibbon et al. | 244/3.12 |
| 4,770,370 | 9/1988 | Pinson | 244/3.12 |
| 4,860,968 | 8/1989 | Pinson | 244/3.12 |

FOREIGN PATENT DOCUMENTS

| | | |
|---|---|---|
| 0192550 | 8/1986 | European Pat. Off. . |
| 1244020 | 7/1967 | Fed. Rep. of Germany . |
| 3004635 | 8/1981 | Fed. Rep. of Germany . |
| 0008105 | 1/1981 | Japan . |
| 0193403 | 11/1984 | Japan . |

OTHER PUBLICATIONS

"Fiber Optics for Industrial Use", American Cystoscope Makers, Inc. 6/7/61.

OA Fiberscope System, American Optical Corporation, Spie Journal 4/1970 pp. G-17.

AO Fiberoptics, American Optical, 9/3/74, pp. 1-9.

*Primary Examiner*—David H. Brown

*Attorney, Agent, or Firm*—Michael W. Sales; Wanda K. Denson-Low

[57] ABSTRACT

An optical missile sight that provides a gunner with the ability to view along a missile line of sight in order to sight a potential target prior to missile launch. The sight comprises an imaging telescope, an optical coupling arrangement that comprises (1) a flexible fiber optic bundle disposed in obedient sheathing, or (2) a reflective optics arrangement and a fiber optic bundle, and an objective lens employed for viewing. In the case of the flexible fiber optic bundle, the telescope is disposed along the centerline of the missile, and the optical components of the optical coupling arrangement are disposed in a flexible housing that extends from inside the missile to the outside of the launch tube. In one embodiment the fiber optic bundle is sheared during launch, while in another embodiment, the fiber bundle is separated at the missile/launch tube interface prior to launch. In the case of the reflective optics arrangement, the optical components of the telescope are disposed inside the missile and the optical coupling arrangement components are disposed both inside and outside of the missile, and a fiber optics bundle is employed to transmit the image scene to the gunner outside the launch tube.

10 Claims, 3 Drawing Sheets

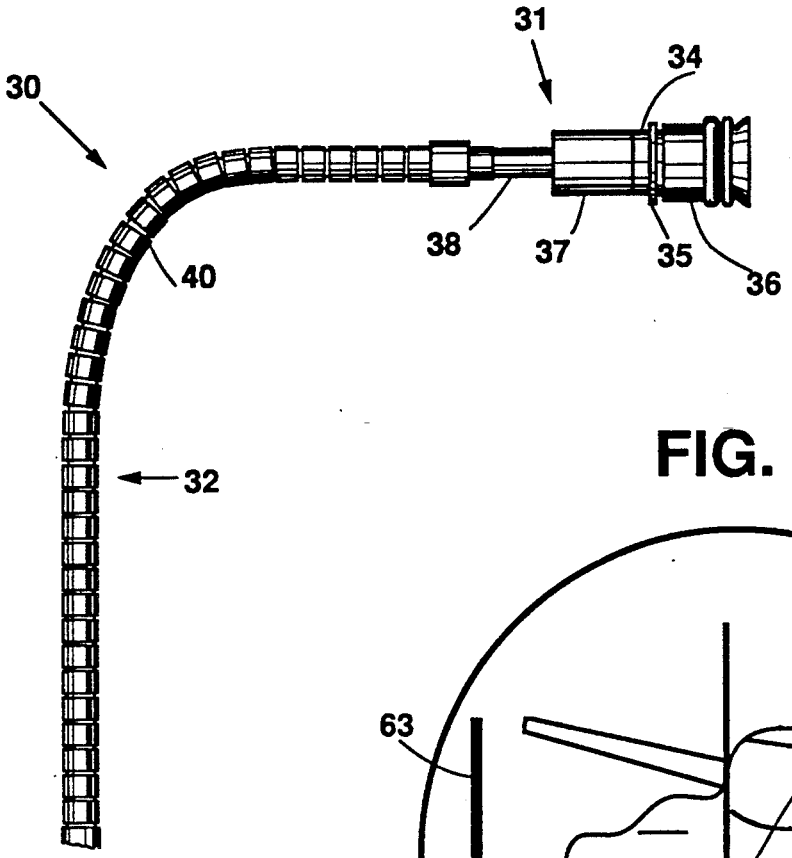
FIG. 5.
FIG. 6.
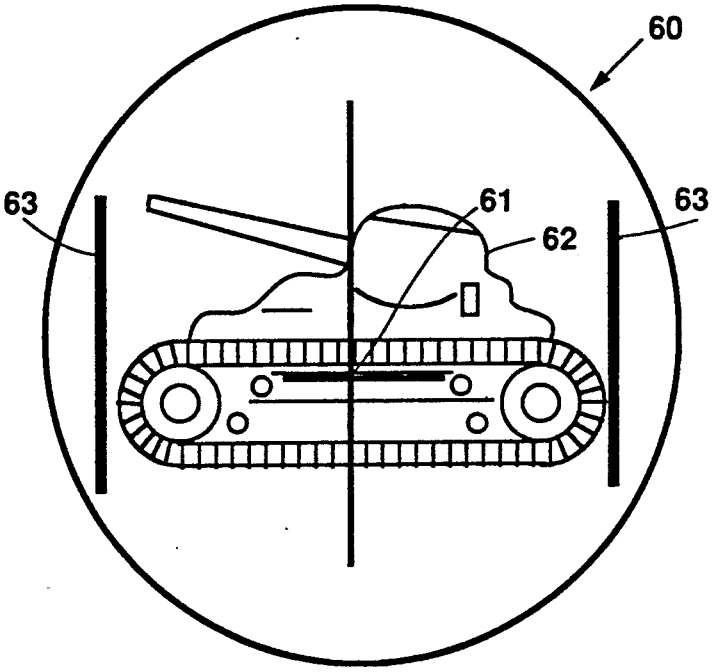
FIG. 7.
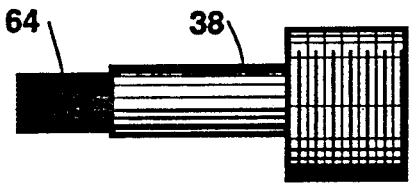
FIG. 8.
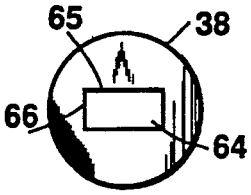
FIG. 9.
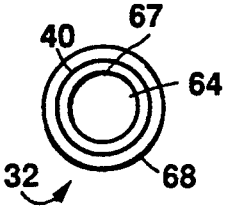

IMAGING TARGET SIGHT

BACKGROUND

The present invention relates generally to sighting devices, and more particularly, to a missile sighting device for use with a man-portable missile.

Conventional man-portable missiles incorporate sighting mechanisms that are located outside the launch tubes. Consequently, aiming errors are present due to the inaccuracy of the sight alignment with the missile center axis or the center axis of its inertial guidance system.

Accordingly, there has been a need for a small arms and man-portable missile sight that permits the gunner to directly sight down the center of the missile axis, and which simplifies the optical alignment procedures during manufacture.

SUMMARY OF THE INVENTION

In accordance with the features and advantages of the present invention, an optical missile sight provides a gunner with the ability to look along a missile line of sight in order to sight a potential target prior to missile launch. The sight comprises (1) an imaging telescope, (2) an optical coupler that comprises (a) a flexible fiber optic bundle disposed in a flexible housing that extends from inside the missile to outside the missile launcher or (b) a reflective optical coupler having components disposed inside and outside the missile and a fiber optic bundle disposed in a flexible housing that is located outside the missile launcher, and (3) an objective lens employed for viewing. In embodiments that employ the flexible fiber optic bundle and housing, the telescope is disposed along the centerline of the missile, or at a slight angle relative to the centerline of the missile, and the optical components of the optical coupling arrangement are disposed intermediate the ends of the flexible housing that extends from inside the missile to the outside of the launch tube.

In one embodiment the fiber optic bundle is sheared during launch, while in another embodiment, the fiber bundle is separated at the missile/launch tube interface prior to launch. In the case of the reflective optics arrangement, the optical components of the telescope are disposed inside the missile and the optical coupling arrangement components are disposed both inside and outside of the missile, and a fiber optics bundle is employed to convey images to the gunner. The sight extends from inside the missile where it is aligned to optimize the sighting of the missile toward its intended target, to outside the launch tube and to the gunner's location.

The flexible sheath or housing comprises a flexible sheath formed of two interlocked spiral coils. It may be made of plastic, or a metal such as chrome plated steel, stainless steel, or the like. Such a flexible sheath is conventionally used in gooseneck lamps or microphone stands, and may be manually bent into a curved shape and will remain in that shape. Such a housing allows the gunner to position the eyepiece for best viewing. Once positioned, it will not move. This is sometimes known as obedient sheathing material. The fiber optic bundle is also flexible, and is disposed within the flexible housing and permits conveying images from the image scene to the gunner. The sight thus permits the gunner to look generally along the line of sight of the missile he is about to launch. Whatever the gunner aims at will be the target that the missile goes after.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which:

FIG. 5 is a plan view of a flexible sight constructed in accordance with the principles of the present invention;

FIG. 6 is an image of a target obtained through the sight of FIG. 5 showing a reticle or cross hairs and showing stadia markers;

FIG. 7 is a side view of a threaded ferrule used in the remote imaging target sight of FIG. 5 to terminate a bundle of optical fibers;

FIG. 8 shows the viewing end of the threaded ferrule of FIG. 7 illustrating how the ends of the bundle of optical fibers define a rectangular planar viewing matrix; and FIG. 9 is a cross-sectional view of a viewing tube assembly of the flexible sight of FIG. 5 illustrating the various layers that it includes.

DETAILED DESCRIPTION

Figure 1A:
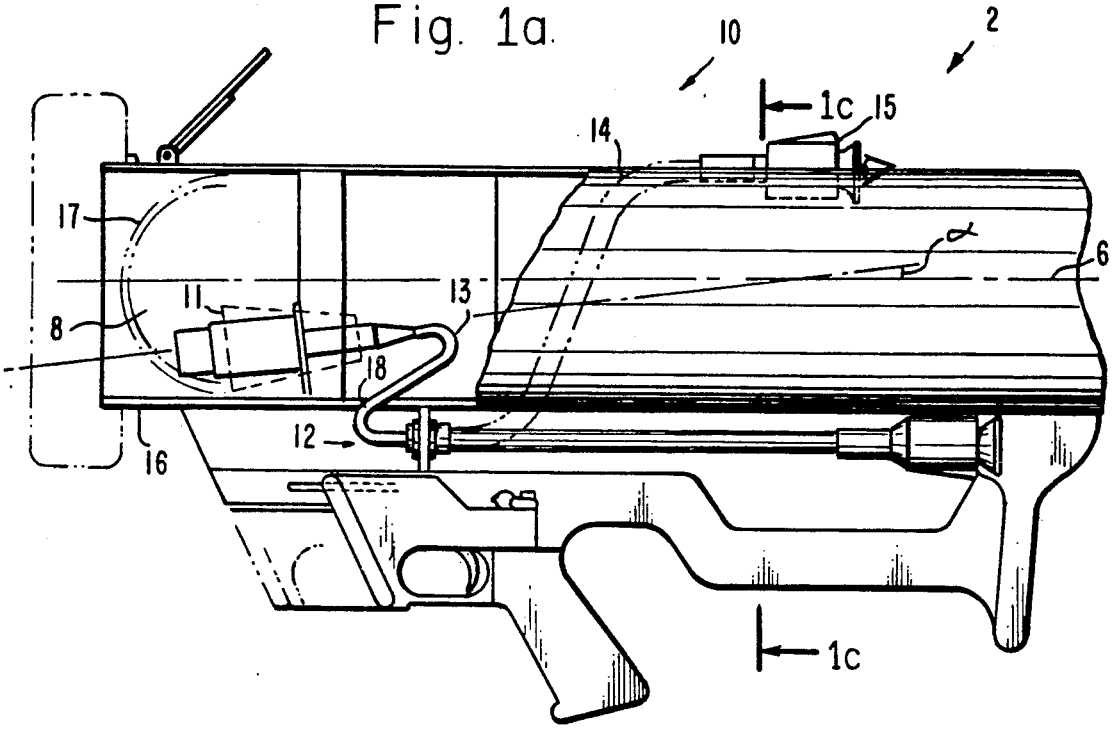
FIG. 1*a* shows a first embodiment of a flexible sight in accordance with the principles of the present invention integrated into a missile and launch tube.
Figure 1B:
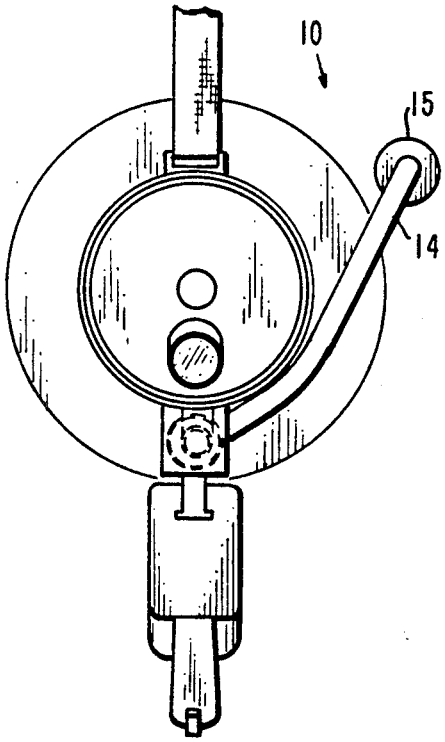
FIG. 1*b* is a front view of the missile and launch tube of FIG. 1*a;*
Figure 1C:
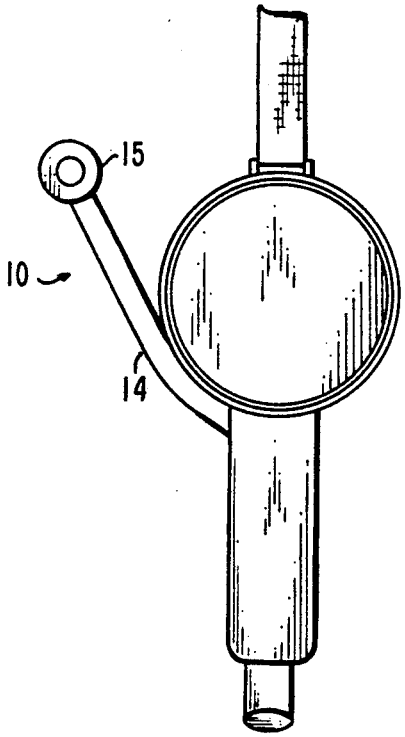
FIG. 1*c* is a cross sectional view of the missile and launch tube of FIG. 1*a* and FIG. 1*b* taken along the line c—c of FIG. 1*a;*
Figure 2:
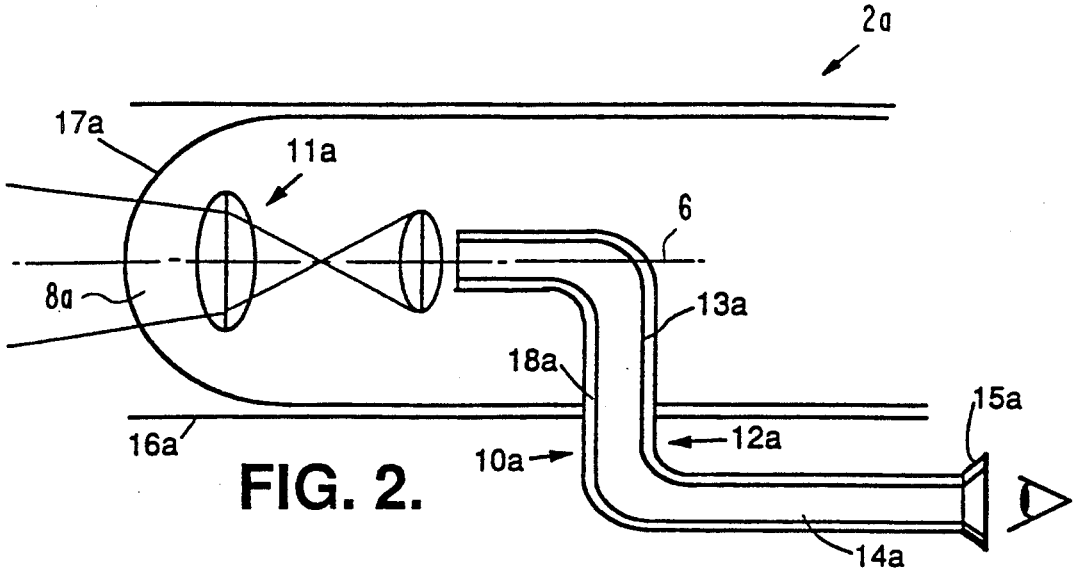
FIG. 2 shows a second embodiment of a flexible sight in accordance with the principles of the present invention.
Figure 3:
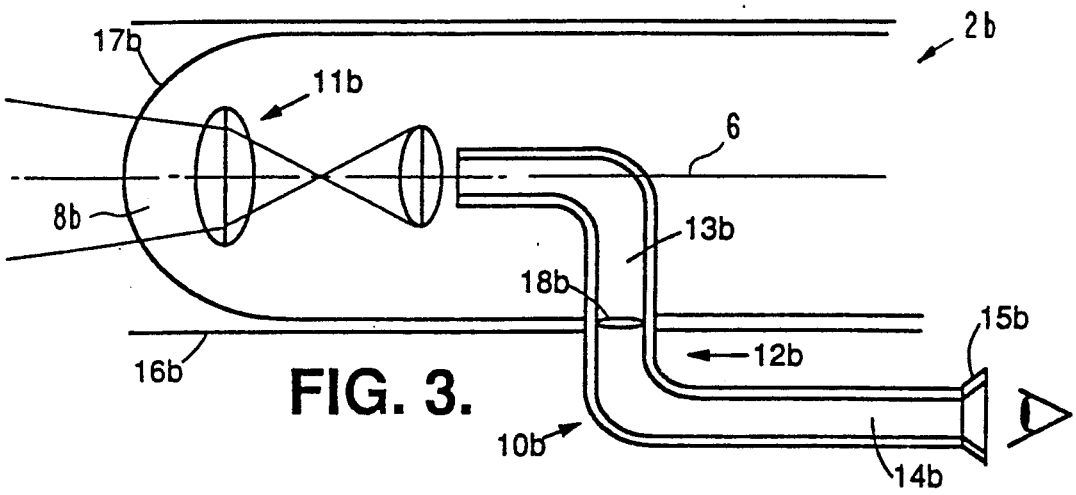
FIG. 3 shows a third embodiment of a flexible sight in accordance with the principles of the present invention.
Figure 4:
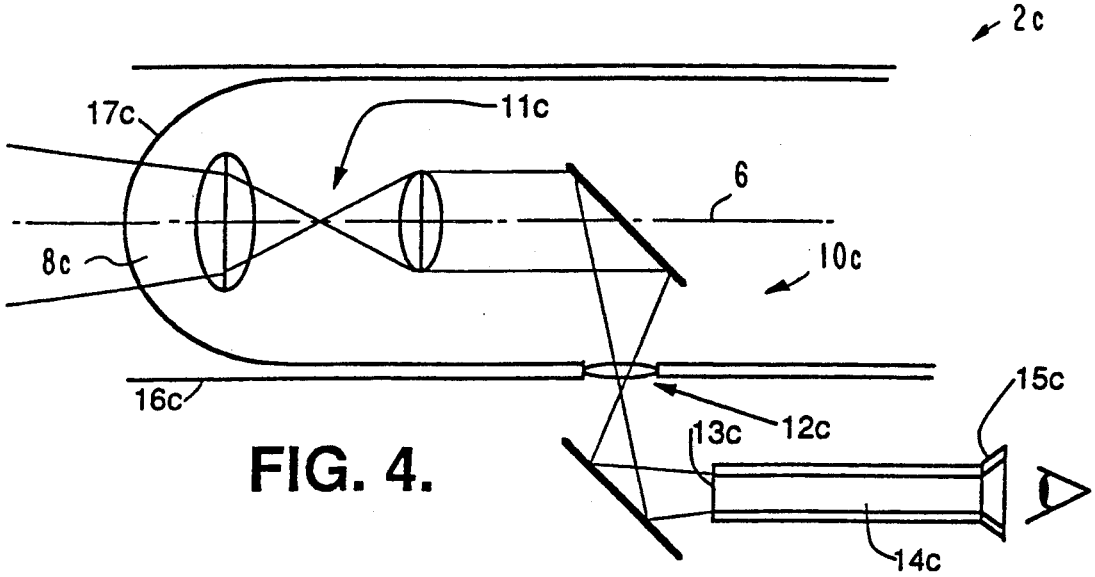
FIG. 4 shows a fourth embodiment of a flexible sight in accordance with the principles of the present invention.

Referring to the drawings, FIG. 1*a*, FIG. 1*b*, and FIG. 1*c* show a first embodiment of an optical missile sight 10 in accordance with the principles of the present invention. The optical missile sight 10 has one end disposed in the interior of a missile 17, and has the other end disposed on or near the exterior of a missile launch tube 16. FIG. 1*a* shows a side view of the missile 17 and launch tube 16 partly in section and partly broken away. FIG. 1*b* shows a front view of the missile 17 and launch tube 16. FIG. 1*c* shows a cross sectional view taken along the line c—c of FIG. 1*a* of the missile 17 and launch tube 16. FIG. 1*a* is a first embodiment for a missile system 2 where a telescope 11 is tilted at an angle to the centerline of the missile. This embodiment may be used in applications where loft of the missile relative to the target is desired at launch. FIGS. 2, 3, and 4 generally depict the preferred embodiment of a missile system according to the invention wherein a telescope is aligned with the centerline and line of sight of the missile. In both the aligned and tilted telescope embodiments, the telescope 11 is disposed in the nose of the missile and looks outward toward a target (not shown) such as a tank, etc.

The optical missile sight 10 provides a gunner with the ability to look down the center axis of the missile 17 in order to aim at a potential target prior to missile launch. The sight 10 comprises an imaging telescope 11, an optical coupling arrangement 12 that comprises a flexible fiber optic bundle 13 disposed within a flexible housing 14, and an objective lens 15 employed for viewing. The telescope may be secured in place using screws, epoxy, brackets, or other conventional means. The housing 14 comprises a metal or plastic housing 14 that flexes into a desired shape selected by the gunner. The housing 14 may comprise two interlocked spiral coils such as is used on a gooseneck lamp, or on a microphone stand, or used in armored electrical cable such as BX cable. Such a housing 14 enables a gunner to position the objective lens 15 for best viewing.

Once positioned, the position of the objective lens 15 does not move because the housing 14 is made of obedient sheathing material. The fiber optic bundle 13 is also flexible, and is disposed within the flexible housing 14 and permits transmission of light from the image scene to the exterior of the launch tube 16. The telescope 11 is disposed along the centerline 6 of the missile 17, and the optical components of the optical coupling arrangement 12 are disposed in a flexible housing 14 that extends from inside the missile 17 to outside of the launch tube 16.

In operation, the sight 10 provides a gunner with the ability to sight directly along the centerline of the missile 17. Once a potential target is determined, the missile 17 is launched and the fiber optic bundle 13 is sheared where the surface of the missile 17 adjoins the surface of the launch tube 16 such as at 18.

FIG. 2 shows a second embodiment of an optical sight 10*a* in accordance with the principles of the present invention. The sight 10*a* comprises substantially the same components as in the embodiment of FIG. 1. The embodiment of FIG. 2 shows the area 18*a* where the fiber optic bundle 13*a* shears. This occurs at first movement between missile body 17*a* and launch tube 16*a*. The fiber optic bundle 13*a* is about ⅛ inch thick and is rigidly bonded together in this area to form a brittle glass tube.

The separation may be accomplished by using a form of umbilical connector as shown in the embodiment of FIG. 3. Two imaging fiber bundles may be butted together to pass the image on to the gunner. The butt junction 18*b* is disconnected at the first movement between missile body and launch tube 16*b*. In this embodiment, the portion of the housing 14*b* and fiber optic bundle 13*b* that is outside of the launch tube 16*b* is potentially reusable for subsequent missile launches.

FIG. 4 shows a fourth embodiment of an optical sight 10*c* in accordance with the principles of the present invention. This embodiment incorporates a reflective optics arrangement. The sight 10*c* incorporates the telescope 11*c* and reflective optical coupling arrangement 12*c* that transmits light from the telescope to the exterior of the missile 17*c* at the gunner's location. A fiber optics bundle 13*c* disposed in a flexible housing 14*c* is also employed, but these components are disposed completely outside of the launch tube 16*c*. The flexible housing 14*c* is typically secured to the side of the launch tube in a position appropriate for use by the gunner. In the case of the reflective optics arrangement of FIG. 4, the optical components of the telescope 11*c* are disposed inside the missile 17*c* and components of the optical coupling arrangement 12*c* are disposed both inside and outside of the missile 17*c*. A fiber optics bundle 13*c* is employed to transmit the image to the gunner. The sight 10*c* extends from inside the missile 17*c* where it generally looks down the center axis of the missile 17*c*, to outside the launch tube and to the gunner's location by means of the fiber optics bundle 13*c* and housing 14*c*.

The sight 10, 10*a*, 10*b*, 10*c* in the disclosed embodiments, permits the gunner to look down the center axis of the missile 17 he is about to launch. Whatever the gunner aims at will be the target that the missile 17 goes after. Accordingly, the sight of the present invention permits the gunner to directly sight down the center of the missile axis. The design of the sight simplifies the optical alignment procedures during manufacture.

Heretofore, iron sights for aiming man-portable missiles have been located on the exterior of the launch tube. This arrangement makes it difficult to accurately align the sight. First, an inertial sensor assembly (ISA) is installed in the missile and aligned therewith. Then, the missile is inserted into the launch tube, and the launch tube is aligned with the ISA in the missile. Finally, the iron sight on the exterior of the launch tube is aligned with the axis of the launch tube. The slightest shock or jar throws the whole system out of alignment.

In accordance with the present invention, the optical sight and the ISA are married together. The optical sight inside the missile is rigidly affixed to the ISA by welding, screwing or bonding with epoxy cement. Thus, when the ISA is aligned to the missile, the optical sight is aligned to the missile at the same time. Accordingly, it does not matter whether the launch tube is aligned to the missile, or whether the optical sight is aligned to the launch tube. As long as the optical sight is aligned to the ISA, the central processing unit inside the missile accurately guides the missile along the line of sight. Consequently, aiming errors typically present in conventional missile launching systems due to the inaccuracy of sight alignment with the missile center axis or the center axis of the missile's inertial guidance system are corrected.

Referring now to FIG. 5 of the drawings, there is shown the external portion of a flexible sight 30 constructed in accordance with the principles of the present invention. The flexible sight 30 has an objective lens assembly 31 connected to one end of an elongated flexible viewing tube assembly 32. The flexible sight 30 comprises a plurality of lenses adapted to have a preselected magnifying power based upon the normal scenario in which the weapon is employed. One of the lenses may be removable and replaceable. Utilization of a replaceable lens adapts the flexible sight 30 for use at different focal lengths. This permits the use of the weapon for differing sighting environments and target distances. The objective lens assembly 31 includes a lens housing 34 containing a plurality of lenses and having a focusing adjustment ring 35. The lens housing 34 may be any conventional objective having two, three or four lenses, and having an aperture 25 mm in diameter or less. A suitable lens housing 34 is obtainable from Edmunds Scientific, 101 E. Gloucester Pike, Barrington, N.J. A flexible eyecup 36 made of rubber or neoprene, or the like, is slipped over the viewing end of the lens housing 34 like a boot. If desired, the eyecup 36 may be cemented in place although it is not usually necessary because of the snug fit. The eyecup 36 excludes ambient light and fits the facial contours of a gunner and acts as a cushion. A suitable eyecup 36 is also available from Edmunds Scientific.

A cylindrical barrel 37, which is threaded at both ends, has the lens housing 34 screwed into one end thereof. The cylindrical barrel 37 may be made of a plastic such as polycarbonate, or the like. The cylindrical barrel 37 serves the purpose of maintaining the lens housing 34 at a suitable focal distance. A threaded ferrule 38 screwed into the other end of the cylindrical barrel 37. The threaded ferrule 38 is fastened to one end of a flexible sheath 40 formed of two interlocking spiral coils. The flexible sheath 40 may be made of plastic or a metal such as stainless steel, chrome plated steel, or the like. This type of flexible sheath 40 may be manually bent into a curved shape and will remain in that shape. It is conventionally used in gooseneck lamps, microphone stands or armored electrical cable such as that known as BX cable. A suitable flexible sheath 40 may be obtained from MCM Electronics, 650 Congress Park Dr., Centerville, Ohio. The flexible sheath 40 forms the obedient sheathing part of the viewing tube assembly 32. Typically, for use in the embodiment illustrated in FIG. 5, the flexible sheath 40 may be on the order of 12 to 20 inches long. However, in special situations, the viewing tube assembly 32, including the flexible sheath 40, may be five or six feet long, if desired.

Referring now to FIG. 6, there is shown an image 60 that is typical of that formed in the flexible sight 30. The flexible sight 30 is provided with a reticle or cross hairs 61 that may be lined up on a target such as a tank 62. Stadia markers 63 are provided within the flexible sight 30 to give an indication of the the target range. For example, if a tank of known size exactly fills the distance between the stadia markers 63, then the tank 62 is exactly 500 yards away.

Referring now to FIG. 7, there is shown a side view of the threaded ferrule 38. The ferrule 38 is shown unscrewed and separated from the cylindrical barrel 37 and separated from the flexible sheath 40 that were shown in FIG. 5. Protruding from one end of the threaded ferrule 38 are broken-away strands of a bundle of optical fibers 64. There may be 40,000 strands, for example, in the bundle of optical fibers 64. Each strand may be on the order of 0.0025 inch thick, and each strand is made of high quality optical glass that transmits light with high efficiency. A suitable bundle of optical fibers 64 may be obtained from the Galileo Company, located in Massachusetts.

FIG. 8 shows the viewing end of the threaded ferrule 38 shown in FIG. 7. The bundle of optical fibers 64 is arranged in the form of a rectangular matrix having a top 65 and a side 66. The ends of the strands are arranged in a predetermined order and bonded permanently together. The end of the bundle of optical fibers 64 is optically polished to form a smooth planar surface. The other end of the bundle of optical fibers 64 is finished in the same manner, and the individual strands are arranged in the same predetermined order. Any image that is focused on the matrix at the far end travels down the bundle of optical fiber 64 and appears on the matrix at the near or viewing end. In order to focus on the matrices, the lenses are located about 0.5 inches therefrom which is the approximate focal distance. This separation between the objective lens and the matrix is provided by the cylindrical barrel 37 shown in FIG. 5. Fine adjustment of the focus is achieved by moving the adjustment ring 35. It will be understood that the embodiment illustrated is by way of example only. If desired, the matrix may be square or circular, for example, and the number of strands may be more or less than 40,000. If desired, the Galileo Co. will provide the entire viewing tube assembly 32 ready made, terminated at both ends, optically polished and ready to use.

FIG. 9 shows a cross sectional view of a typical viewing tube assembly 32 constructed in accordance with the invention. The bundle of optical fibers 64 is covered with a protective sheath 67 which may be made of heat shrink tubing, if desired. The protective sheath 67 keeps the bundle of optical fibers 64 free from mechanical abrasion. Around that layer is disposed the flexible sheath 40 that was described in detail hereinbefore. Finally, around the flexible sheath 40 there may be placed an outer covering 68 that also may be made of heat shrink tubing, if desired. This outer covering 68 may be omitted, if desired, although in some cases it may help to keep dust and grit out of the viewing tube assembly 32, and it also may serve ornamental purposes.

In operational use, the first step is to adjust this focusing adjustment ring 35 to focus the image on the matrix at the far end of the viewing tube assembly 32. The objective lens assembly 31 is moved to the appropriate location by bending the flexible sheath 40. Appropriate attachments such as a polarizing filter and an infrared filter are selected. If desired, a zoom lens may be attached and switched in or out. After use, the entire weapon may be discarded or thrown away, if desired.

Thus there has been described a new and improved missile sighting device for use with a man-portable missile. It is to be understood that the above-described embodiments are merely illustrative of some of the many specific embodiments which represent applications of the principles of the present invention. Clearly, numerous and other arrangements can be readily devised by those skilled in the art without departing from the scope of the invention.

What is claimed is:

1. A weapon system for use by a gunner comprising:
- a missile or like article having a nose section and a centerline along the length of the missile;
- a launch tube for receiving and launching the missile;
- an imaging telescope disposed inside the missile in the nose section and having a predetermined line of sight relative to the centerline for looking out from the nose of the missile to provide an image of a target;
- an objective lens assembly disposed outside the missile and the launch tube for providing an image to the gunner;
- means for optically coupling the image from the telescope and to the objective lens assembly; and
- means for separating said coupling means prior to or during launch whereby said telescope is disconnected from said objective assembly after launch.

2. The weapon system of claim 1 wherein the objective lens assembly is secured to the launch tube.

3. The weapon system of claim 1 wherein the telescope is disposed along the line of sight of the missile such that the line of sight of the telescope is the line of sight of the missile.

4. The system of claim 1 wherein the separating means includes an imbilical connector assembly.

5. The system of claim 1 wherein the telescope is disposed such that the line of sight of the telescope is at an angle to the centerline of the missile.

6. The system of claim 1 wherein said telescope terminates at an exterior surface of the launch tube.

7. The system of claim 1 wherein said coupling means includes at least two reflectors disposed between the telescope and the objective lens assembly for reflecting the image outside the missile.

8. The system of claim 1 wherein the image is a visible light image.

9. The system of claim 1 wherein the coupling means includes a fiber optic cable within a flexible housing.

10. The system of claim 9 wherein the separating means comprises an aperture in the launch tube for shearing the cable when the missile is launched.

* * * * *